US007069624B2

(12) United States Patent
Johnson

(10) Patent No.: US 7,069,624 B2
(45) Date of Patent: Jul. 4, 2006

(54) ATTACHMENT OF A SLING

(76) Inventor: David A. Johnson, P.O. Box 12517, Salem, OR (US) 97309

( * ) Notice: Subject to any disclaimer, the term of this patent is extended or adjusted under 35 U.S.C. 154(b) by 186 days.

(21) Appl. No.: 10/913,201

(22) Filed: Aug. 6, 2004

(65) Prior Publication Data

US 2006/0026805 A1 Feb. 9, 2006

(51) Int. Cl.
*A44B 21/00* (2006.01)
*F41C 23/02* (2006.01)

(52) U.S. Cl. ..... 24/302; 224/150; 224/913; 42/85; 42/94

(58) Field of Classification Search ..... 24/302, 24/164, 197, 182, 573.11; 224/257, 258, 224/150, 913, 149; 42/85, 94
See application file for complete search history.

(56) References Cited

U.S. PATENT DOCUMENTS 2,446,197 A * 8/1948 Sloan ..... 224/150
3,495,770 A * 2/1970 Rolling et al. ..... 224/150
4,555,051 A * 11/1985 Johnson ..... 224/150
5,110,022 A * 5/1992 Dvoroznak et al. ..... 224/150
5,802,756 A * 9/1998 Hightower ..... 42/85
6,068,167 A * 5/2000 Hopson ..... 224/150
2004/0182894 A1* 9/2004 Johnson ..... 224/150
2004/0188476 A1* 9/2004 Johnson ..... 224/150

OTHER PUBLICATIONS

U.S. Appl. No. 10/392,463, filed Mar. 18, 2003, Johnson.
U.S. Appl. No. 10/795,954, filed Mar. 8, 2004, Johnson.
Safety Systems Corporation, "Instructions for M-16 Tactical Weapon Sling" and "Instructions for Tactical Weapon Sling Attachments CAR/SMG," 1990.
Boonie Packer Products, "BP-53 AR15-M16 Carbine Sling Installation," at least as early as 2002.

* cited by examiner

*Primary Examiner*—Robert J. Sandy
(74) *Attorney, Agent, or Firm*—Chernoff, Vilhauser, McClung & Stenzel, LLP

(57) ABSTRACT

A sling for carrying an elongate item such as a shoulder weapon having a buttstock and a forward end. In one embodiment, a bight of relatively small strap material is held in a sling swivel by a stopper mounted on the bight so that it can be passed through the sling swivel when the bight is slack, but which seats against the sling swivel when the bight is tight, keeping the bight engaged with the sling swivel. In another embodiment, a stopper keeps a bight of a stock-encircling strap engaged with a sling swivel, preventing the sling swivel from marring the stock.

25 Claims, 5 Drawing Sheets

ATTACHMENT OF A SLING

BACKGROUND OF THE INVENTION

The present invention is related to slings for carrying objects such as military and hunting rifles, and relates particularly to the attachment of such slings to objects to be carried.

Sling swivels have long been used on military and sporting rifles and other shoulder weapons to attach slings to the weapons, but the conventional use of metal clips or hooks to attach an end of a sling to a sling swivel can result in unwanted noise when the weapon is being carried, and such fittings must be chosen in a size appropriate to the sling strap and the sling swivel. Additionally, a metal sling fastening device may damage the finish on a stock.

Some slings have been equipped with flexible fabric members that can be fastened through a sling swivel to attach an end of a sling to a buttstock, forestock, or barrel of a weapon, but there has been some concern that the use of flexible connecting elements that are relatively small, by comparison with the size of the main sling strap members, might cause undesirable pressure and wear on the finish of a wooden gunstock.

Accordingly, what is desired is a sling including front and rear attachment portions which offer secure and strong connection to a an item to be carried, yet which is easily attached to or disconnected from sling swivels of more than one size at either end of the item, which will not cause unnecessary wear on a finish, and which can be manufactured at a competitive cost.

SUMMARY OF THE INVENTION

The present invention provides an answer to the aforementioned shortcomings of the previously known sling attachments and slings by providing an attachment assembly for attaching an end of a sling to a sling swivel.

In one preferred embodiment, a loop of relatively narrow and flexible strap material is attached to the end of the main body of the sling, together with a stopper that allows the strap to be mounted easily, yet securely, in a sling swivel to attach a sling to an end of a rifle or another elongate object which it is desired to carry by the use of the sling.

In one preferred embodiment of the present invention, a loop of relatively wide flexible strap material is arranged to extend around a buttstock of a shoulder weapon as a stock-encircling loop, and a length of relatively narrow flexible strap material is attached to the stock-encircling loop with sufficient slack for a bight of the narrow strap material to be inserted through a sling swivel, together with a properly oriented stopper that thereafter is kept oriented by tension in the strap material, to prevent unintended retraction of the bight of narrow strap material from the sling swivel.

In one preferred embodiment of the invention, a length of relatively narrow strap material has a pair of ends attached alongside each other to an end of a relatively wide main sling strap member so as to form a bight, and a stopper mounted on the relatively narrow strap material can be inserted through the opening of a sling swivel in one orientation, but thereafter is reoriented and maintains attachment of the bight of narrow strap material, and thus that end of the main sling strap member, to the sling swivel until the stopper is intentionally manipulated to permit its removal.

In one preferred embodiment of the sling attachment assembly, a stock-encircling strap includes a smoothly folded bight that extends through a sling swivel and is engaged by a stopper to keep the bight of the stock-encircling strap attached to the sling swivel.

In one preferred embodiment of the invention, a stopper may be manufactured of molded strong and rigid plastics material, thus avoiding noisy metal-to-metal contact between the sling and the sling swivel.

The foregoing and other objectives, features, and advantages of the invention will be more readily understood upon consideration of the following detailed description of the invention taken in conjunction with the accompanying drawings.

DETAILED DESCRIPTION OF PREFERRED EMBODIMENTS

Figure 1:
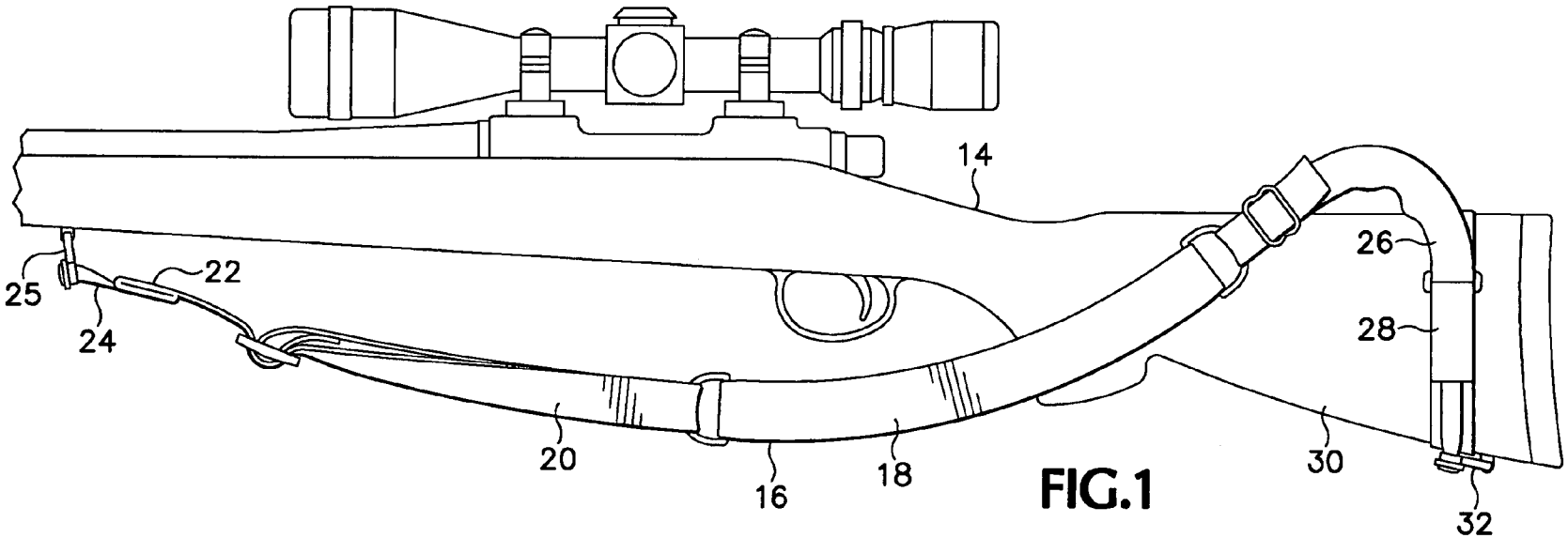
FIG. 1 is a side elevational view of a rifle equipped with a sling embodying the present invention.

Referring now to the drawings which form a part of the disclosure herein, in FIG. 1, a hunting rifle 14 is equipped with a sling 16 including a main sling body of suitably flexible, strong, and wide strap material. In the sling 16 as shown in FIG. 1, a rear strap portion 18 of the main body of the sling has attached to it a front strap portion 20 that is adjustable in length and has a front end 22.

A front end attachment portion 24 interconnects the front end 22 with a front sling swivel 25 mounted on the forestock of the hunting rifle 14, and will be described in greater detail presently.

A rear end attachment assembly 26 is interconnected with a rear end of the rear strap portion 18. The rear end attachment assembly 26 includes a stock-encircling loop portion 28 that extends around the buttstock 30 and is attached to a rear sling swivel 32.

Figure 2:
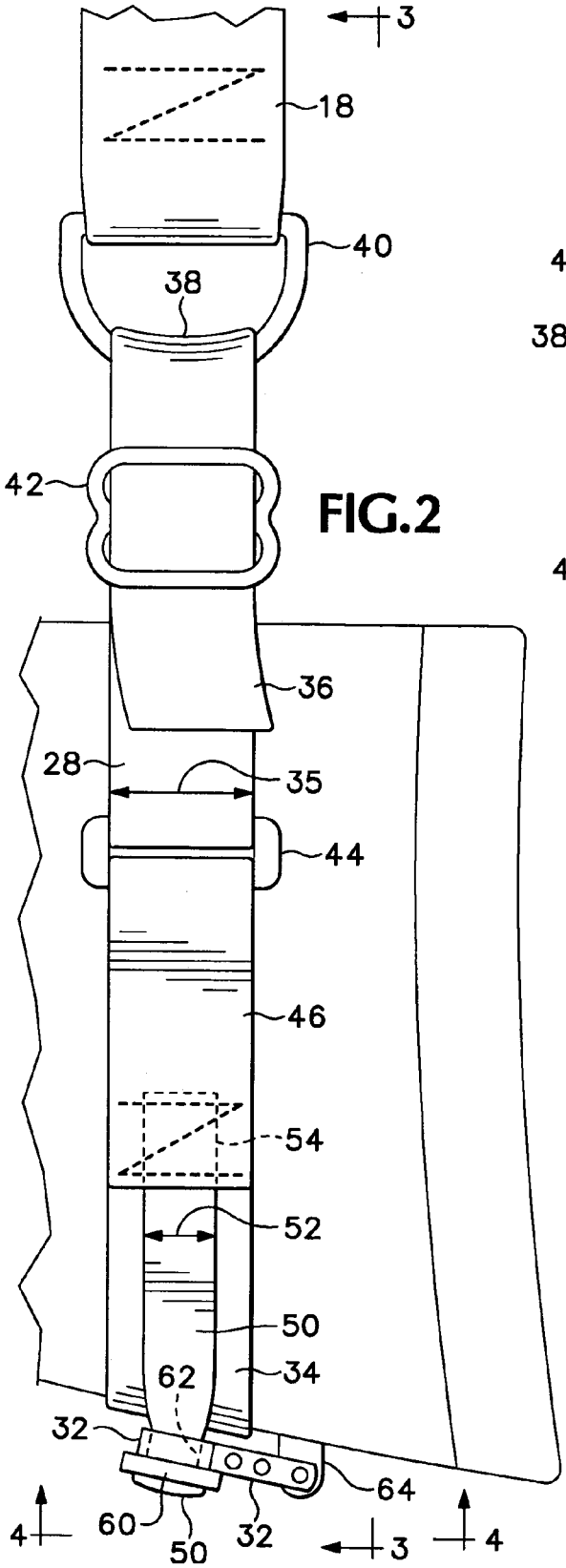
FIG. 2 is a side elevational view, at an enlarged scale, of a rear portion of the buttstock of the rifle shown in FIG. 1, together with a rear end attachment assembly and a part of the rear end of the main sling body of the sling shown in FIG. 1.
Figure 3:
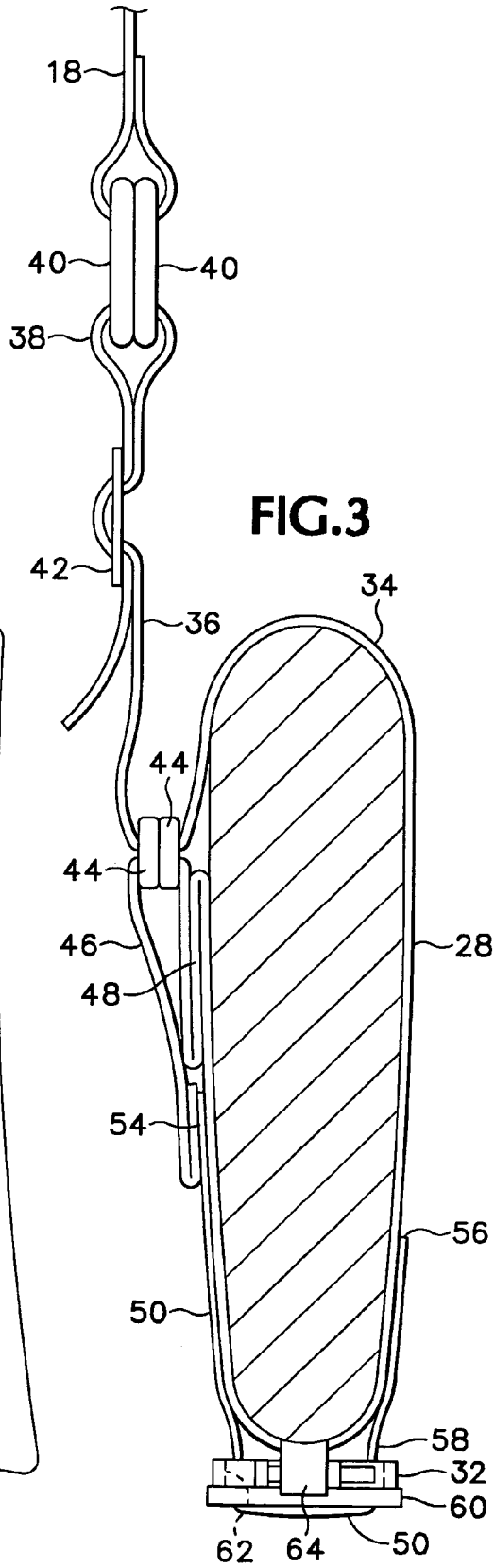
FIG. 3 is a view taken along line 3—3 of FIG. 2, showing the manner of attachment of the rear attachment assembly of the sling to the buttstock of the rifle shown in FIG. 1.
Figure 4:
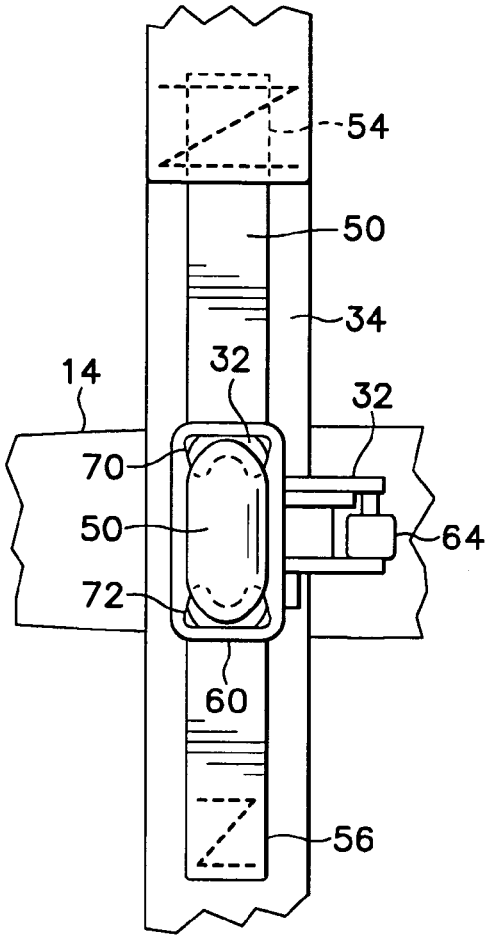
FIG. 4 is a view taken in the direction of the line 4—4 of FIG. 2, showing a part of the rear attachment assembly of the sling shown in FIGS. 1–3, in an outspread configuration for ease of understanding, together with a sling swivel engaged with the rear end attachment assembly.

Referring next to FIGS. 2, 3, and 4, the rear end attachment assembly 26 is shown in greater detail, and it may be seen that the stock-encircling loop portion 28 is part of a first strap member 34 which may be of a suitably strong woven fabric such as a strong and relatively non-elastic nylon webbing material having a suitable width 35 of, for example, 1 inch. The width 34 is preferably great enough to assure that the strap member has enough area in contact with the buttstock 30 to avoid undue wear on its finish. A first end part 36 of the first strap member 34 is secured to the rear strap portion 18 by an adjustable loop 38 fastened through a pair of D-rings 40 mounted at the rear end of the rear strap portion 18. A suitable fastener such as a three bar slide buckle 42 secures the first end part 36 to form the loop 38.

A pair of slide loops 44 are attached to a second end of the strap member 34 by a loop 46 formed in the strap member 34 and suitably secured, as by a suitable pattern of stitching. Preferably, the strap member 34 is folded over upon itself into a Z-shaped portion 48 along one side of the loop 46 to provide an amount of additional stiffness and thus keep the slide loops 44 conveniently oriented and located where the intermediate portion of the first strap member 34, between the slide buckle 42 and the loop 46, can slide through the slide loops 44 to tighten the stock-encircling loop portion 28 snugly about the buttstock 30. The Z-shaped folded portion 48 may be secured by a suitable pattern of stitching through the fabric webbing material of the first strap member 34.

A flexible strap member 50 is narrower than the first strap member 34, having a width 52 of about ½ inch, for example. The strap member 50 is preferably also of a woven fabric web material, but need not have as great a strength as the wider first strap member 34. A first end 54 of the strap 50 is securely attached to the outer side of the first strap member 34, as by being sewn to the first strap member 34 at a location which may, for example, be adjacent to the loop 46. A second end 56 of the second strap member 50 is also attached to the outer side of the first strap member 34 with a suitably strong connection, as by being sewn to the first strap member 34, at a position spaced apart from the loop 46 along the first strap member 34 by a distance which is less than the length of the second strap member 50, as shown best in FIG. 4, thus leaving a loose bight 58 in the second strap member 50. For example, the length of the second strap 50 between its ends 54 and 56 may be greater by about 1¼ inch than the distance between the attachments of the ends 54 and 56 to the first strap member 34.

A flat stopper 60 is mounted on the narrower second strap member 50 before its first and second ends 54 are attached to the first strap member 34, and thus the stopper 60 is permanently mounted on the second strap member 50. The bight 58 of the second strap member 50 extends through the strap-receiving opening 62 in the rear sling swivel 32, and the stopper 60 rests against the sling swivel 32 and prevents the second strap member 50 from being removed from the opening 62. Thus, when the sling swivel 32 is attached in the normal manner to the buttstock 30, as by being engaged with a stud 64 mounted in the bottom of the buttstock 30, the stock-encircling loop portion 28 is prevented from sliding forward along the buttstock 30 by the strap member 50 and the sling swivel 32. The first strap member 34 is thus located between the sling swivel 32 and the buttstock 30, protecting the finish of the buttstock 30 from being marred by the sling swivel 32. Engagement of the second strap member 50 with the sling swivel 32 also prevents the stock-encircling loop portion 28 from sliding around the buttstock 30, so that the first end part 36 of the first strap member 34 extends away from the slide loops 44 on a desired side of the buttstock 30, as shown in FIG. 1, so that the sling 16 may be mounted on the rifle 14 for use by either a right-handed or left-handed shooter.

Figure 5:
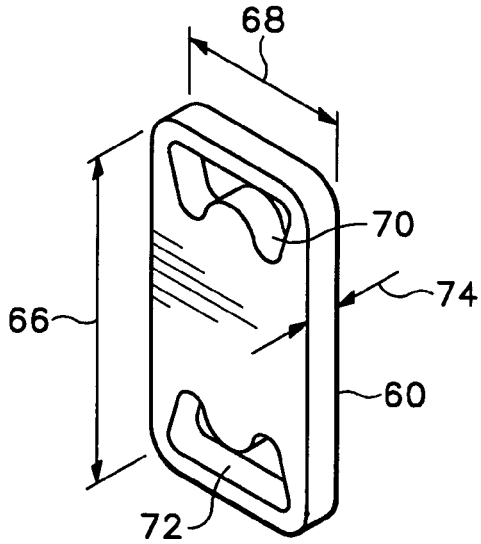
FIG. 5 is an isometric view of an exemplary stopper for incorporation in the sling shown in FIGS. 1–4.

As shown in FIG. 5, the stopper 60 is generally planar and elongate, with a length 66 and a width 68 preferably slightly larger than the size of the loop portion of the sling swivel 32 and thus larger than the strap-receiving opening 62 in the sling swivel 32, although the stopper 60 is useable with sling swivels of different sizes. The stopper 60 may be made of a suitably strong and stiff plastics material, so as to be quieter than a conventional metal sling connecting clip or hook. A pair of openings 70 and 72 are provided at the opposite ends of the stopper 60, and the strap member 52 is engaged with the stopper 60 by extending each of its ends 54 and 56 through a respective one of the openings 70 and 72, so that a portion of the strap member 52 extends along one generally planar side of the stopper 60 while both of the ends 54 and 56 extend away from the opposite side of the stopper 60.

Figure 6:
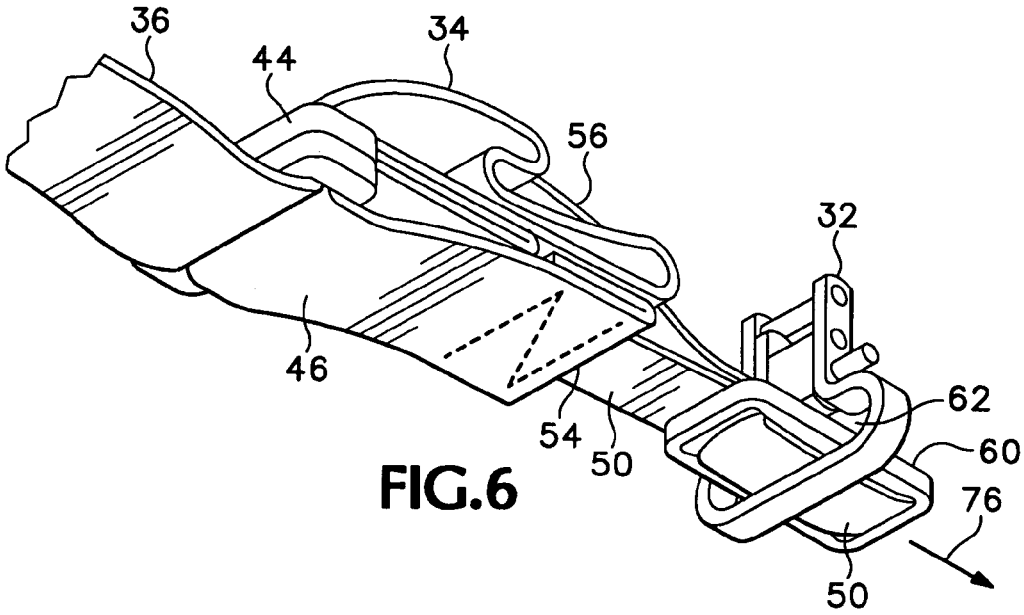
FIG. 6 is an isometric view showing the manner of connecting the rear end attachment assembly to a sling swivel.

The stopper 60 has a thickness 74 sufficient to provide enough rigidity so that the stopper 60 cannot buckle and be pulled through the strap-receiving opening 62 in the sling swivel 32 by the second strap member 50, but the thickness 74 is small enough so that the stopper 60, together with the bight 58 of the second strap member 50, can be passed through the strap-receiving opening 62 in the sling swivel 32 in the direction of the arrow 76 in FIG. 6 to engage the rear end attachment assembly 26 with the sling swivel 32. Disengagement is simply the opposite of the engagement procedure. Either engagement with the sling swivel 32 or disengagement from the sling swivel 32 is best accomplished with the stock-encircling loop portion 28 loosened or removed from the buttstock 30 to provide slack in the first strap member 34 as shown in FIG. 6.

Once the stopper 60 has passed entirely through the opening 62 in the sling swivel 32 and tension is applied to the second strap 50, the stopper 60 aligns itself alongside the sling swivel 32 as shown in FIGS. 2, 3, and 4, thus preventing the second strap 50 from being withdrawn from engagement with the rear sling swivel 32 until sufficient slack is again provided in the bight 58 to permit the stopper 60 to be reoriented with respect to the opening 62 and slid back through the opening 62 of the sling swivel 32.

Figure 7:
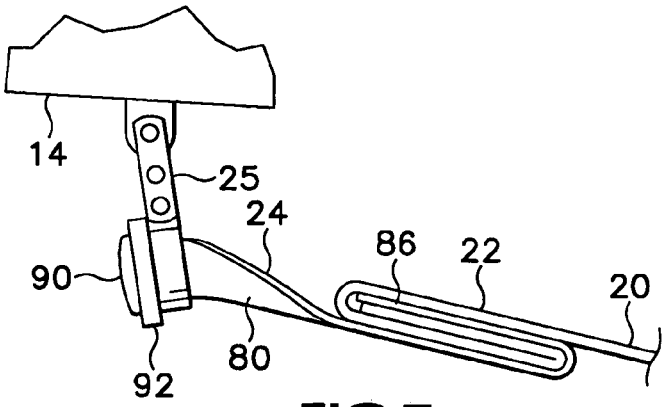
FIG. 7 is a left side elevational view, at an enlarged scale, showing the attachment of the front end portion of the sling to the forestock of the rifle shown in FIG. 1.
Figure 8:
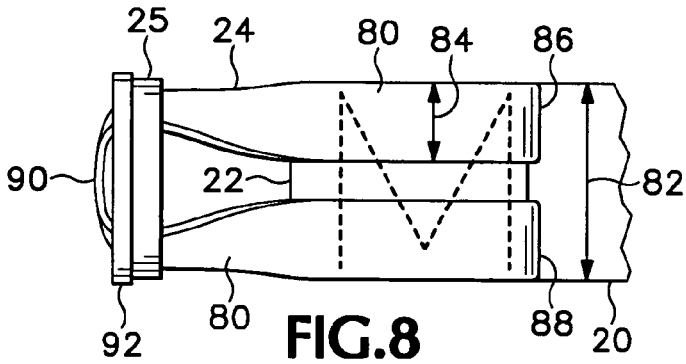
FIG. 8 is a bottom plan view showing the attachment of the front end portion of the sling to the sling swivel shown in FIG. 7.
Figure 9:
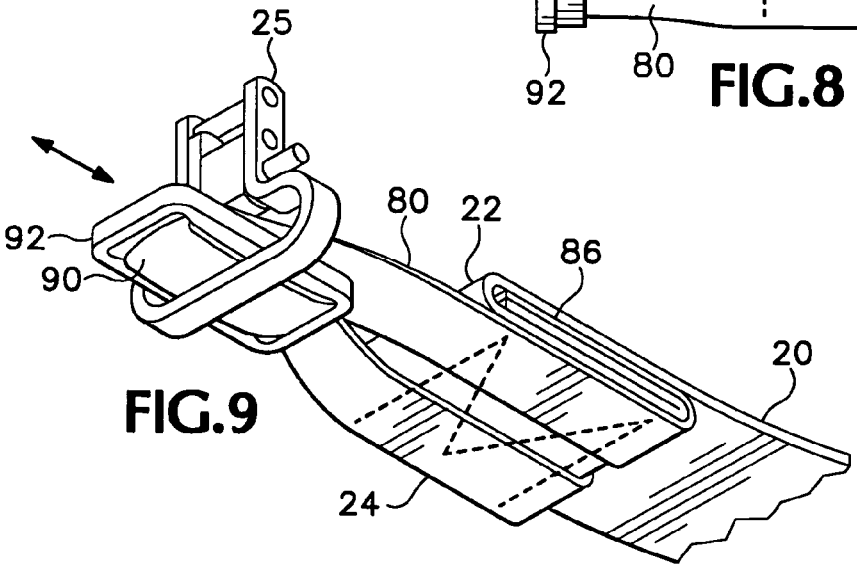
FIG. 9 is an isometric view showing the manner of connecting the front end attachment portion shown in FIGS. 1, 7, and 8 to a sling swivel.

Referring next to FIGS. 7, 8, and 9, the front end attachment portion 24 includes a narrow strap member 80 attached to the front end 22 of the front strap portion 20 of the main body of the sling 16. The front strap portion 20 may be of conventional strap material such as woven webbing of the sort commonly used in slings for shoulder weapons and may have a width 82 of 1¼ inch, for example, while the narrow strap member 80 may be of web material similar to that of the strap member 50 of the rear end attachment assembly 26. In one embodiment of the front end attachment portion 24, the strap member 80 has a width 84 such as about ½ inch, that is significantly less than the width 82 of the front strap portion 20 of the main body of the sling 16. The narrow strap member 80 preferably has its opposite ends 86 and 88 side by side and parallel with each other and folded into the front end 22 of the front strap portion 20. As shown in FIG. 8, the ends 86 and 88 of the strap member 80 are spaced apart from each other and aligned generally with the side margins of the front strap portion 20. The strap member 80 is sewn, riveted, or otherwise fastened securely to the front end 22 of the front strap portion 20 so that the narrow strap member 80 forms a bight 90 extending forward from the front strap portion 20.

Prior to attachment of the strap member 80 to the front end 22 of the front strap portion 20, a stopper 92 which may be similar to the stopper 60 is mounted on the narrow strap member 80 in the same fashion in which the stopper 60 is mounted on the strap member 50. As shown in FIG. 9, the stopper 92, together with the bight 90 of the strap member 80, can be engaged with the front sling swivel 25 in the same manner described above with respect to engagement of the rear end attachment assembly 26 with the rear sling swivel 32. Therefore, so long as tension is applied to the bight 90 by the front strap portion 20, the stopper 92 is held against the front sling swivel 25 and prevents removal of the front strap portion 20 from connection with the front sling swivel 25. When it is desired to disengage the front end of the sling 16 from the sling swivel 25, the bight 90 must be slackened, and the stopper 92 can be oriented as shown in FIG. 9, and slid out of engagement with the sling swivel 25.

Figure 12:
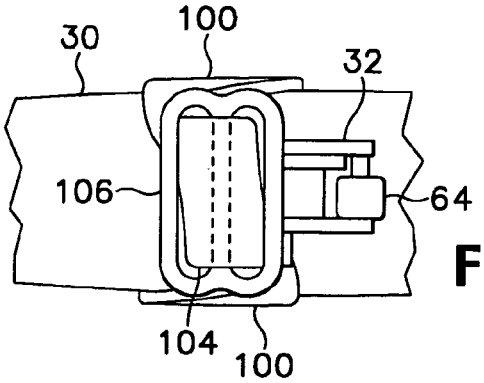
FIG. 12 is a bottom view of the portion of a buttstock and the rear end attachment assembly shown in FIGS. 10 and 11.
Figure 10:
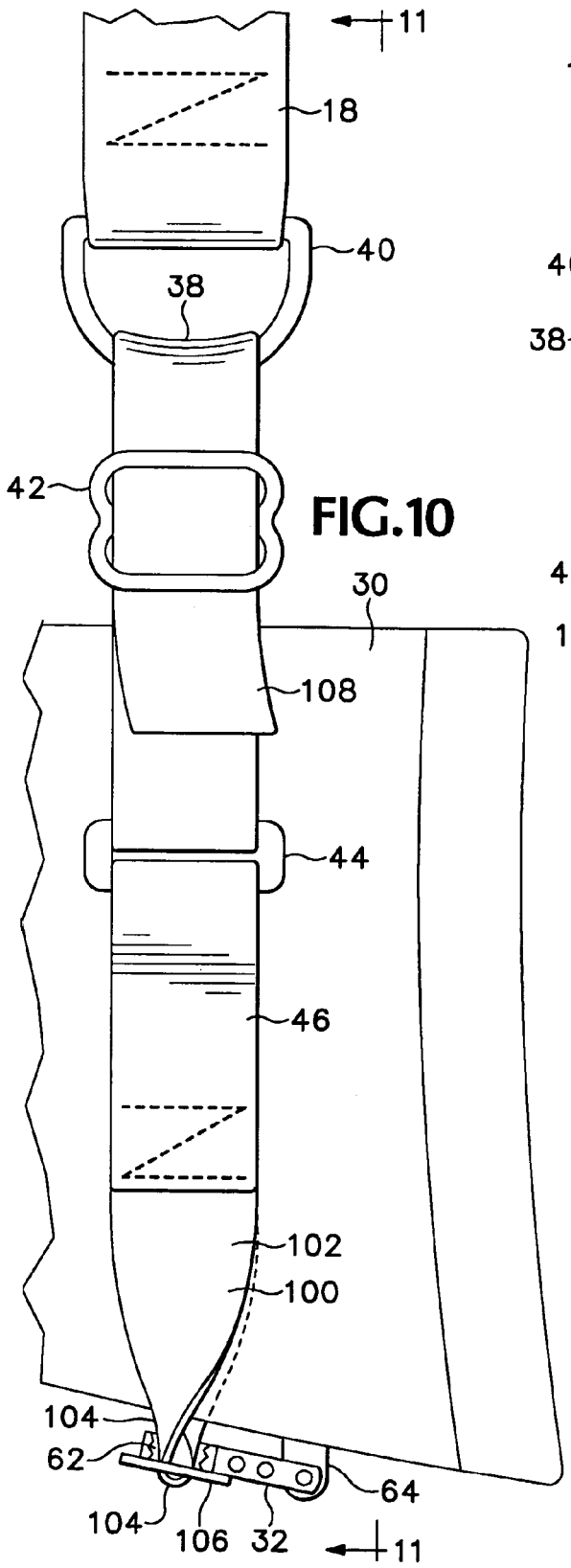
FIG. 10 is a side elevational view, at an enlarged scale, of a rear portion of the buttstock of the rifle shown in FIG. 1, together with a rear end attachment assembly that is a variation of the assembly shown in FIG. 2.
Figure 11:
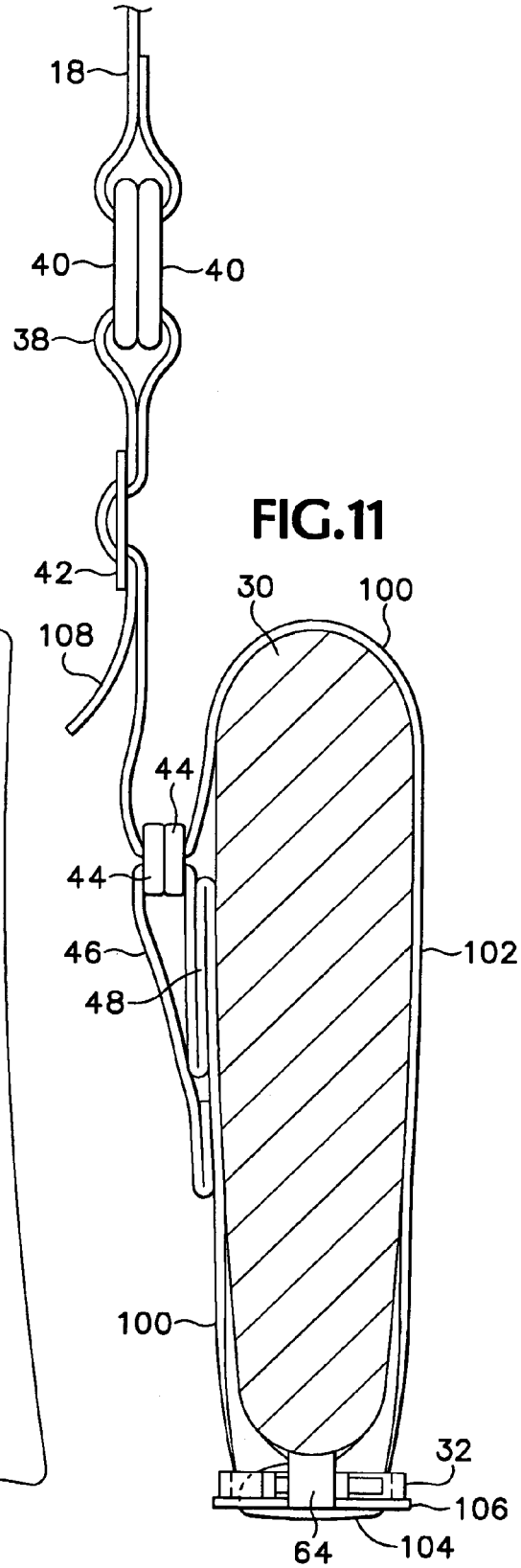
FIG. 11 is a view taken along line 11—11 of FIG. 10, showing the rear end attachment assembly and portion of a buttstock shown in FIG. 10.

Referring now to FIGS. 10, 11, and 12, a rear end attachment assembly 98 that is another embodiment includes a strap member 100 generally similar to the first strap member 34 portion of the stock-encircling loop portion 28 described above, extending around the buttstock 30 as a stock-encircling loop 102. However, there is a half-twist in the strap member 100 within the loop 102, and a bight 104 is formed as a smooth bend or fold transverse to the length of the strap member 100. The bight 104 extends through the opening 62 in the rear sling swivel 32, as may be seen in FIG. 10, where the sling swivel 32 is shown partially cut away. The bight 104 of the strap member 100 is engaged in the normal manner through a stopper such as a three bar slide 106, with the three bar slide 106 beneath the rear sling swivel 32, as shown in FIGS. 10, 11, and 12. The three bar slide 106 thus acts as a stopper to keep the strap member 100 engaged with the sling swivel 32, and the strap member 100 is kept between the sling swivel 32 and the buttstock 40, protecting its finish from being marred by the sling swivel 32.

While the three bar slide 106 may be manipulated in a fashion similar to the previously described manipulation of the stopper 60, to attach the bight 104 to the rear sling swivel 32 or to remove it therefrom, such manipulation is more difficult than manipulation of the stopper 60 and the narrow strap member 50, because the width 108 of the strap member 100 is greater than the width of the strap member 50. Because it is somewhat difficult to manipulate the bight 104 together with the three bar slide 106 to connect the bight 104 with the rear sling swivel 32, it may be preferable, depending upon the particular material of the strap member 100, to thread the end 110 of the strap member through the opening 62 of the sling swivel 32, through the three bar slide 106 in the normal manner, back through the opening 62 in the sling swivel 32, and thence around the buttstock 30, through the loop slides 44, and through the three bar slide buckle 42 and D-rings 40, to attach the strap member 100 to the sling swivel 32, or to rearrange the strap member 100 for use by an opposite handed person.

Because of the half twist in the strap member 100, the parts of the strap member 100 on each side of the buttstock 30 can lie smoothly alongside the lower portion of the buttstock 30 on each side while still resting evenly along the entire width of the center bar of the three bar slide 106. Because there is no additional narrow second strap member in the rear end attachment assembly 98, it is somewhat less costly to produce than the previously described rear end attachment assembly 26.

The terms and expressions which have been employed in the forgoing specification are used therein as terms of description and not of limitation, and there is no intention in the use of such terms and expressions of excluding equivalence of the features shown and described or portions thereof, it being recognized that the scope of the invention is defined and limited only by the claims which follow.

I claim:

1. A rear end attachment assembly for a sling, comprising:

(a) a first strap member having a first end and a second end, said second end being attached to and adjustably movable along an intermediate part of said first strap member, forming a stock-encircling loop;

(b) a flexible second strap member having a pair of opposite ends defining a length, both of said opposite ends being attached to said first strap member at respective locations separated along said first strap member by a distance that is less than said length, so that said flexible second strap member includes a loose bight; and (c) a stopper mounted on said bight of said flexible second strap member and arranged so as to keep said bight engaged with a sling swivel.

2. The rear end attachment assembly of claim 1 wherein said first strap member is wider than said second strap member.

3. The rear end attachment assembly of claim 1 wherein said stopper is elongate and can pass through a strap-receiving opening in a sling swivel in a first, lengthwise orientation, but is held against said sling swivel in a second orientation, in which it cannot pass through said strap-receiving opening, by tension in said second strap member.

4. The rear end attachment assembly of claim 1 wherein said second strap member is no wider than about half as wide as said first strap member.

5. The rear end attachment assembly of claim 1 wherein said second end of said first strap member is connected to said intermediate part thereof by a slide loop permitting said stock-encircling loop to be adjusted in size.

6. The rear end attachment assembly of claim 1 wherein said stopper defines a pair of holes through which said second strap member extends, with a portion of said second strap member extending along a first side of said stopper and with each of said opposite ends extending from a respective one of said pair of holes on a second side of said stopper.

7. The rear end attachment assembly of claim 6 wherein said stopper is in the form of a flat plate.

8. The rear end attachment assembly of claim 6 wherein said stopper is of a rigid plastic material.

9. An attachment portion of a sling, comprising:

(a) an end portion of a main sling body member having a first width;

(b) a length of flexible strap material having a substantially narrower second width and having a pair of opposite ends, said length of flexible strap material being bent into a bight extending away from said end portion of said main sling body member, and said pair of opposite ends being attached to said end portion; and (c) a stopper mounted on said bight and arranged so as to keep said bight engaged with a sling swivel.

10. The attachment portion of claim 9 wherein said stopper defines a pair of holes through which said length of flexible strap material extends, with a portion of said second strap member extending along a first side of said stopper and with each of said opposite ends extending from a respective one of said pair of holes on a second side of said stopper.

11. The attachment portion of claim 10 wherein said stopper is in the form of a flat plate.

12. The attachment portion of claim 10, wherein said stopper of a rigid plastic material.

13. The attachment portion of claim 9 wherein said stopper is elongate and can pass through a strap-receiving opening in a sling swivel in a first, lengthwise orientation, but is held against said sling swivel in a second orientation, in which it cannot pass through said strap-receiving opening, by tension in said flexible strap material.

14. The attachment portion of claim 13 wherein said length of flexible strap material is no wider than about half as wide as said end portion.

15. A sling, comprising:

(a) a main sling body of flexible strap material having a front end and a rear end;

(b) a front end attachment portion located at said front end of said main sling body; and (c) a rear end attachment assembly extending from said rear end of said main sling body, and wherein said rear end attachment assembly includes;

(d) a first strap member having a first end and a second end, said second end being attached to and adjustably movable along an intermediate part of said first strap member, forming a stock-encircling loop;

(e) a flexible second strap member having a pair of opposite ends defining a length, both of said opposite ends being attached to said first strap member at respective locations separated along said first strap member by a distance that is less than said length, so that said flexible second strap member includes a loose bight; and (f) a stopper mounted on said bight of said flexible second strap member and arranged so as to keep said bight engaged with a sling swivel.

16. The sling of claim 15 wherein said first strap member is wider than said second strap member.

17. The sling of claim 16 wherein said second strap member is no wider than about half as wide as said first strap member.

18. The sling of claim 15 wherein said second end of said first strap member is connected to said intermediate part thereof by a slide loop permitting a stock-encircling loop of adjustable size to be formed by said first strap member.

19. The sling swivel of claim 15 wherein said stopper defines a pair of holes through which said second strap member extends, with a portion of said second strap member extending along a first side of said stopper and with each of said opposite ends extending from a respective one of said pair of holes on a second side of said stopper.

20. The sling of claim 19 wherein said stopper is in the form of a flat plate.

21. The sling of claim 19 wherein said stopper is of a rigid plastic material.

22. The sling of claim 15 wherein said stopper can be passed through a strap-receiving opening of a sling swivel in a predetermined orientation when said bight is slack, but is held against said sling swivel in a second orientation, in which it cannot pass through said strap-receiving opening, by tension in said second strap member.

23. A rear end attachment assembly for a sling, comprising:

(a) a strap member having a first end, a second end, and a length, said second end being attached to and adjustably movable along an intermediate part of said strap member, forming a stock-encircling loop, said strap member having a half twist located in said stock-encircling loop, and said strap member being bent along a line transverse to said length, thereby forming and including a bight in said strap member;

(b) a sling swivel defining a strap-receiving opening, said bight extending through said strap-receiving opening and thereby being engaged with said sling swivel; and (c) a stopper mounted on said bight in said strap member and arranged so as to keep said bight engaged with said sling swivel.

24. The rear end attachment assembly of claim 23 wherein said second end of said first strap member is connected to said intermediate part thereof by a slide loop permitting said stock-encircling loop to be adjusted in size.

25. The rear end attachment assembly of claim 23 wherein said stopper is in the form of a three-bar slide.

* * * * *

UNITED STATES PATENT AND TRADEMARK OFFICE

CERTIFICATE OF CORRECTION

PATENT NO. : 7,069,624 B2
APPLICATION NO. : 10/913201
DATED : July 4, 2006
INVENTOR(S) : David A. Johnson It is certified that error appears in the above-identified patent and that said Letters Patent is hereby corrected as shown below:

Column 3, line 16, change “width 34” to --width 35--.

Signed and Sealed this

First Day of May, 2007

JON W. DUDAS
*Director of the United States Patent and Trademark Office*